US008985522B2

(12) United States Patent
Bai et al.

(10) Patent No.: US 8,985,522 B2
(45) Date of Patent: Mar. 24, 2015

(54) METHOD FOR IMPROVING OPERATION DENSITY OF RAIL VEHICLES AND PREVENTING HEAD-ON COLLISION AND REAR-ENDING COLLISION

(75) Inventors: Wei Bai, Shanghai (CN); Jing Bai, Shanghai (CN); Qing Bai, Shanghai (CN); Baolong Feng, Shanghai (CN)

(73) Assignees: Wei Bai (CN); Jing Bai (CN); Qing Bai (CN); Baolong Feng (CN)

( * ) Notice: Subject to any disclaimer, the term of this patent is extended or adjusted under 35 U.S.C. 154(b) by 0 days.

(21) Appl. No.: 13/825,262

(22) PCT Filed: Aug. 9, 2011

(86) PCT No.: PCT/CN2011/001307

§ 371 (c)(1),
(2), (4) Date: Apr. 9, 2013

(87) PCT Pub. No.: WO2012/113123

PCT Pub. Date: Aug. 30, 2012

(65) Prior Publication Data

US 2013/0327897 A1 Dec. 12, 2013

(30) Foreign Application Priority Data

Feb. 26, 2011 (CN) ..... 2011 1 0046202

(51) Int. Cl.
*B61L 21/00* (2006.01)
*B61L 23/26* (2006.01)
(Continued)

(52) U.S. Cl.
CPC ..... *B61L 23/26* (2013.01); *B61L 21/10* (2013.01); *B61L 23/14* (2013.01); *B61L 23/18* (2013.01)
USPC ..... 246/33; 701/19

(58) Field of Classification Search
CPC ..... B61L 23/26; B61L 21/20; B61L 23/18; B61L 23/14
USPC ..... 246/26, 33, 30, 28 R; 701/19
See application file for complete search history.

(56) References Cited

U.S. PATENT DOCUMENTS 2,993,117 A * 7/1961 Huffman ..... 246/169 R
3,069,542 A * 12/1962 Failor ..... 246/33
(Continued)

FOREIGN PATENT DOCUMENTS

CN 1628048 A 6/2005
CN 101254791 A 9/2008
(Continued)

*Primary Examiner* — Jason C Smith
(74) *Attorney, Agent, or Firm* — Drinker Biddle & Reath LLP

(57) ABSTRACT

The present invention provides a method for improving operation density of rail vehicles and for preventing head-on collision and rear-ending collision. Said method divides a rail line into equidistant electronic zones, the length of a zone being greater than the shortest safe distance between two running vehicles. Said method installs a locomotive passing detection alarm device in each zone, when a locomotive travels at high speed on the rail, the locomotive passing detection alarm device corresponding to the zone occupied by the locomotive itself will simultaneously access adjacent front and back zones, and determine whether the two adjacent zones are simultaneously occupied by locomotives. If the two adjacent. zones are simultaneously occupied by locomotives, the locomotive passing alarm device will send an alarm signal to the locomotives to warn or otherwise take measures. The aforesaid method can avoid locomotive head-on collision and rear-end collision and increase transportation density according to the vehicle speed and distance at the same time, thus improving the transportation efficiency.

2 Claims, 1 Drawing Sheet

(51) Int. Cl.

| | |
|---|---|
| ***B61L 21/10*** | (2006.01) |
| ***B61L 23/14*** | (2006.01) |
| ***B61L 23/18*** | (2006.01) |

(56) References Cited

U.S. PATENT DOCUMENTS

| | | | | |
|---|---|---|---|---|
| 3,079,495 | A * | 2/1963 | Ferm et al. | 246/33 |
| 3,794,832 | A * | 2/1974 | Huffman et al. | 246/33 |
| 4,323,210 | A * | 4/1982 | Elder | 246/26 |
| 7,222,003 | B2 * | 5/2007 | Stull et al. | 701/19 |
| 8,478,463 | B2 * | 7/2013 | Knott et al. | 701/20 |
| 2006/0290478 | A1 * | 12/2006 | Stull et al. | 340/425.5 |
| 2010/0063656 | A1 * | 3/2010 | Knott et al. | 701/19 |
| 2011/0106363 | A1 * | 5/2011 | Muller | 701/28 |
| 2013/0187010 | A1 * | 7/2013 | Kim | 246/33 |
| 2013/0325211 | A1 * | 12/2013 | El Fassi | 701/2 |
| 2014/0054424 | A1 * | 2/2014 | Xu et al. | 246/122 R |

FOREIGN PATENT DOCUMENTS

| | | | |
|---|---|---|---|
| CN | 101712331 | A | 5/2010 |
| CN | 102114859 | A | 7/2011 |
| DE | 4406720 | A1 | 8/1995 |
| GB | 2390465 | A | 1/2004 |

* cited by examiner

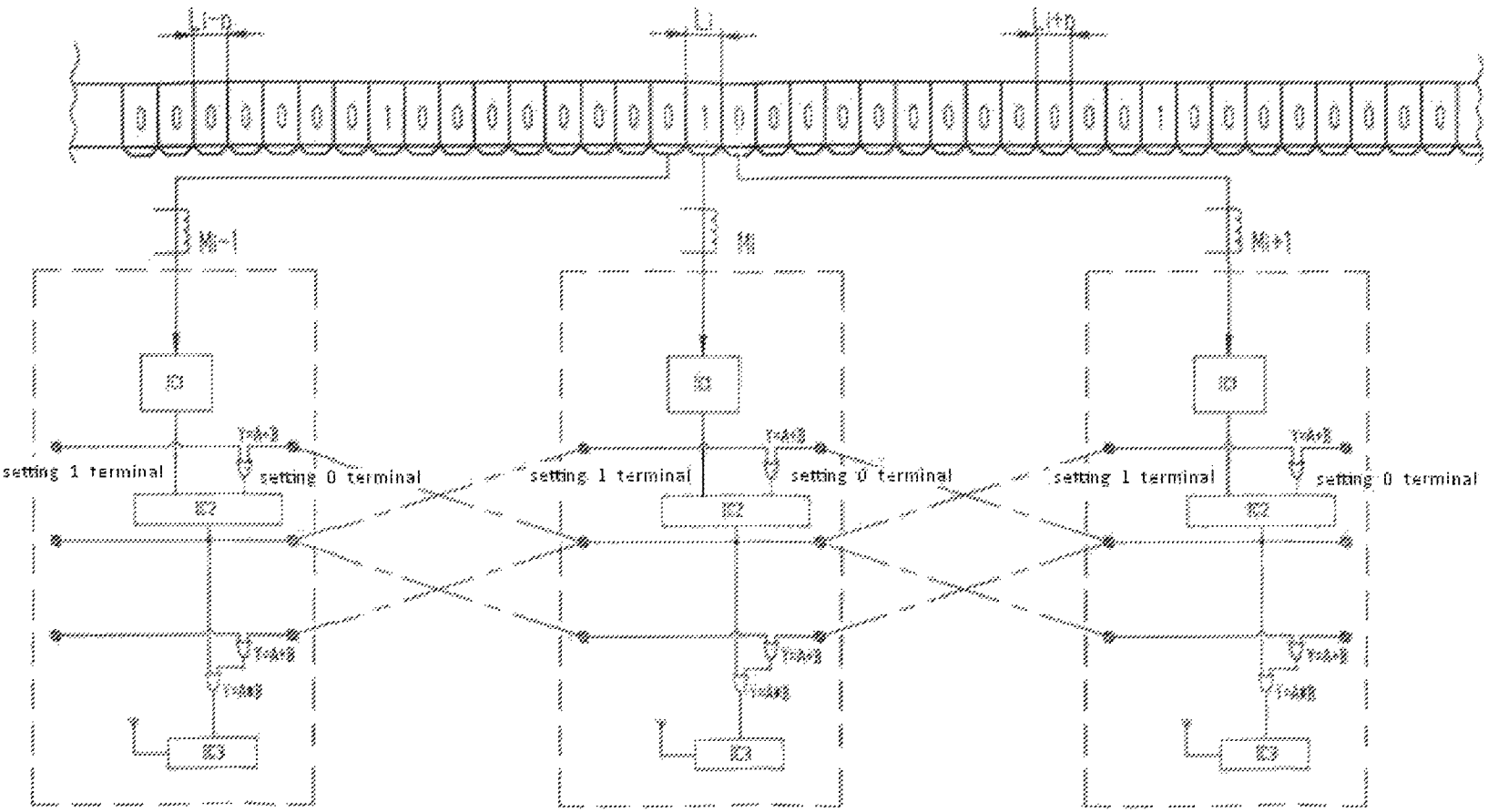
setting 0 terminal
setting 1 terminal
setting 0 terminal
setting 1 terminal
setting 0 terminal
setting 1 terminal

METHOD FOR IMPROVING OPERATION DENSITY OF RAIL VEHICLES AND PREVENTING HEAD-ON COLLISION AND REAR-ENDING COLLISION

CROSS-REFERENCE TO THE RELATED APPLICATIONS

This application is a national stage application (under 35 U.S.C §371) of PCT/CN2011/001307, filed Aug. 9, 2011, claiming the priority of Chinese Patent Application No. 201110046202.6, filed Feb. 26, 2011, the contents of which are incorporated herein by reference in their entirety.

TECHNICAL FIELD

The present invention relates to an early warning technique, and in particular, to an early warning technique for preventing rail vehicles from head-on collision and rear-ending collision.

BACKGROUND ART

In order to ensure the safe operation of rail vehicles running at high speed, traditional dispatch and control methods and technology are indispensable, such as automatic signal blocking, wireless scheduling, and manual siren alert when an emergency breaks out and so on. However, the early-warning technique becomes very limited and insufficient when it is applied to several vehicles running at high speed on the same rail. In an accident, a head-on collision or rear-ending collision is possible among vehicles, causing enormous damages to life or property.

SUMMARY OF THE INVENTION

In order to avoid vehicle collision and increase operation density for improving operation efficiency, the present invention provides a method for improving operation density of rail vehicles and for preventing head-on collision and rear-ending collision.

In order to solve the aforementioned problem, the present invention adopts the following solution: it divides a rail line into equidistant electronic zones, the length of a zone being greater than the shortest safe distance between two running vehicles, and it installs a locomotive passing detection alarm device Mi in each zone; the locomotive passing detection alarm device Mi comprises a whole range sensor component disposed within this zone, a signal processing circuit connected to the signal output terminal of the sensor component, an alarm signal transmitting circuit IC3 connected to the output terminal of the signal processing circuit; the signal processing circuits of the locomotive passing detection alarm devices Mi in adjacent zones transmit signals to one another; when a locomotive occupies a certain zone Li, the whole range sensor component of the locomotive passing detection alarm device Mi corresponding to the zone Li senses the presence of the locomotive and enables the signal processing circuit to generate an "occupied" signal; when a locomotive goes out of the zone Li and enters the onward adjacent zone Li+1, the signal processing circuit of the locomotive passing detection alarm device Mi+1 corresponding to the adjacent zone Li+1 generates an "occupied" signal as well, and transmits the "occupied" signal to the signal processing circuit of the locomotive passing detection alarm device Mi driving out of the backward adjacent zone Li earlier, thereby changing the "occupied" signal generated by the signal processing circuit into a "free" signal; when the two adjacent zones Li and Li+1 are both occupied by the locomotives, the locomotive passing detection alarm devices Mi and Mi+1 corresponding to the two adjacent zones Li and Li+1 simultaneously transmit their respective "occupied" signals to the opposite party, causing the signal processing circuits of the locomotive passing detection alarm devices Mi and Mi+1 corresponding to these two adjacent zones to output a trigger signal simultaneously to initiate the alarm signal transmitting circuit to give an alarm signal to the locomotive in the corresponding zone, the alarm signal receiving and answering device disposed within the locomotive receives this alarm signal to warn or otherwise take measures. For the specific measures and solution, please refer to the Chinese invention patent "Electronic Zone-Based Network Operation Scheduling System for Rail Vehicles" with the application number 201210307124.5.

The signal processing circuit for realizing the aforesaid function is easy to those skilled in the art and comes with various kinds of structures. The technical solution recited in the invention aims at solving the following problem: several locomotives driving on the same rail keep a. certain safe distance from one another, once certain two locomotives are getting closer than they should be, the alarm signal transmitting circuit disposed within the rail electronic zone will give an alarm signal to notify the two locomotives to take measures simultaneously and respectively so as to avoid head-on collision or rear-ending collision.

The method recited in the invention can avoid locomotive head-on collision and rear-ending collision and increase transportation density according to the vehicle speed and distance at the same time, thus improving the transportation efficiency.

DESCRIPTION OF DRAWINGS

FIG. 1 is a diagram illustrating the principle of the invention, wherein: Mi represents a locomotive passing detection alarm device; IC1 represents an sensor signal generating circuit; IC2 represents setting "1" priority bistable circuit; and IC3 represents an alarm signal transmitting circuit.

SPECIFIC EMBODIMENTS

Below, the invention will be explained in detail in combination with the accompanying drawing.

The present invention discloses a method for improving operation density of rail vehicles and preventing head-on collision and rear-ending collision. This method divides a rail line into equidistant electronic zones, the length of a zone being greater than the shortest safe distance between two running vehicles, and installs a locomotive passing detection alarm device Mi in each zone; the locomotive passing detection alarm device Mi comprises a whose range sensor component disposed within this zone, a signal processing circuit connected to the signal output terminal of the sensor component, an alarm signal transmitting circuit IC3 connected to the output terminal of the signal processing circuit; the signal processing circuits of the locomotive passing detection alarm devices Mi in adjacent zones transmit signals to each other; when a locomotive occupies a certain zone Li, the whole range sensor component of the locomotive passing detection alarm device Mi corresponding to the zone Li senses the presence of the locomotive and enables the signal processing circuit to generate an "occupied" signal; when a locomotive drives out of the zone Li and enters the onward adjacent zone Li+1, the signal processing circuit of the locomotive passing detection alarm device Mi+1 corresponding to the adjacent zone Li+1 generates an "occupied" signal as well, and transmits this "occupied" signal to the signal processing circuit of the locomotive passing detection alarm device Mi driving out of the backward adjacent zone Li. earlier, where the signal processing circuits are different, the specific signal input terminals are also different, the "occupied" signal generated by this signal processing circuit is thereby changed into a "free" signal; when the two adjacent zones Li and Li+1 are both occupied by the locomotives, the locomotive passing detection alarm devices Mi and Mi+1 corresponding to these two adjacent zones Li and Li+1 simultaneously transmit their respective "occupied" signals to the opposite party, causing the signal processing circuits of the locomotive passing detection alarm devices Mi and Mi+1 corresponding to these two adjacent zones to output a trigger signal simultaneously to initiate the alarm signal transmitting circuit to give an alarm signal to the locomotive in the corresponding zone, the alarm signal receiving and answering device disposed within the locomotive receives this alarm signal to warn or otherwise take measures.

Said whole range signal processing circuit of the locomotive passing detection alarm device Mi comprises a locomotive passing sensor signal generating circuit IC1 connected to the signal output terminal of the sensor component, and a setting "1" priority bistable circuit IC2, the setting "1" terminal of the setting "1" priority bistable circuit IC2 is connected to the output terminal of the locomotive passing sensor signal generating circuit IC1, the setting "0" terminal of the setting "1" priority bistable circuit IC2 is connected with a first OR gate, the output terminal of the setting "1" priority bistable circuit IC2 is connected to an input terminal of an "AND" gate, the other input terminal of said "AND" gate is connected with a second OR gate, the output terminal of said "AND" gate is connected to a trigger terminal of an alarm signal transmitting circuit IC3, the two input terminals of said first OR gate and second OR gate are respectively connected to the output terminals of the setting "1" priority bistable circuit IC2 in the onward adjacent locomotive passing detection alarm device Mi+1 and the backward adjacent locomotive passing detection alarm device Mi−1.

A basic idea of the invention is two adjacent zones in the line cannot be occupied by the locomotives simultaneously, that is to say, the output terminals of the setting "1" priority bistable circuits IC2 in the locomotive passing detection alarm devices Mi and Mi+1 disposed in two adjacent zones cannot be set "1" at the same time to guarantee enough safe distance between locomotives.

When a locomotive occupies a certain zone "Li", an output terminal of the setting "1" priority bistable circuit IC2 in the corresponding locomotive passing detection alarm device Mi is set to 1, i.e. generating an "occupied" signal; after the locomotive leaves the zone "Li", the output terminal of the setting "1" priority bistable circuit IC2 in the locomotive passing detection alarm device Mi is set to "0", i.e. generating a "free" signal.

When driving at high speed in the rail, a locomotive keeps on setting an output terminal of the setting "1" priority bistable circuit IC2 in the locomotive passing detection alarm device Mi corresponding to the zone Li occupied by itself to "1", and simultaneously visit the two adjacent onward zone and backward zone Li−1 and Li+1 and make determinations. If the two adjacent onward zones and backward zones are occupied by other locomotives, an output terminal of the setting "1" priority bistable circuit IC2 in Mi is set to 1, at the same time, the setting "1" priority bistable circuit IC2 in Mi−1 and/or Mi+1 is also set to 1, said signal will be passed to the second OR gate of the locomotive passing detection alarm devices in adjacent zones to simultaneously initiate the alarm signal transmitting circuit to give an alarm signal to the locomotives in the corresponding zone, said alarm signal indicating that other locomotives are getting closer, an alarm signal receiving and answering device disposed within the locomotive receives this alarm signal to warn or otherwise take measures.

When a locomotive completely passes a certain zone Li and enters the next zone Li+1, an output terminal of the setting "1" priority bistable circuit IC2 in the locomotive passing detection alarm device Mi+1 is set to "1", and this signal is returned to the first OR gate of Mi connected thereto so as to make an output terminal of the setting "1" priority bistable circuit IC2 in the onward zone locomotive passing detection alarm device Mi be set to "0" and reset, indicating that the line is available and back to normal in zone Li, at this time, the alarm signal transmitting circuit IC3 gives no alarm signal.

The technical solution recited in the invention is not limited to the aforesaid hardware connection methods, there is still a variety of other methods that can be easily accomplished by those skilled in the art, for example, a computer control system can be used to connect the sensor circuits in all zones, the signals of the induction circuits in various zones are processed by the computer to determine whether locomotives are getting closer in adjacent zones, if so, the computer will given an alarm signal instruction.

The invention claimed is:

1. A method for improving operation density of rail vehicles and for preventing head-on collision and rear-ending collision comprising dividing a rail line into equidistant electronic zones each with a length greater than the shortest safe distance between two running vehicles and installing a locomotive passing detection alarm device (Mi) in each of the zones, wherein the locomotive passing detection alarm device comprises a whole range sensor component disposed within each of the zones, wherein a signal processing circuit is connected to a signal output terminal of the whole range sensor component, and wherein an alarm signal transmitting circuit (IC3) is connected to the output terminal of the signal processing circuit, transmitting a signal from the signal processing circuits in each zone to signal processing circuits in each adjacent zone;

wherein when a first rail vehicle occupies one of the zones (Li), the signal processing circuit of the locomotive passing detection alarm device (Mi) generates an Li occupied signal, wherein when the first rail vehicle exits the zone (Li) and enters the onward adjacent zone (Li+1), the signal processing circuit of the locomotive passing detection alarm device (Mi+1) corresponding to the adjacent zone Li+1 generates an Li+1 occupied signal and transmits the Li+1 occupied signal to the signal processing circuit of the locomotive passing detection alarm device Mi, which changes the Li occupied signal to an Li free signal, wherein when zone Li is occupied by the first rail vehicle and adjacent zone Li+1 is occupied by a second rail vehicle, and each of the signal processing circuits of the locomotive passing detection alarm devices Mi and Mi+1 simultaneously transmit an occupied signal to the opposite signal processing circuit, a trigger signal is generated by each of the signal processing circuits to initiate an alarm signal transmitting circuit to give an alarm signal to each of the rail vehicles in zones Li and Li+1.

2. The method of claim 1, wherein said signal processing circuit of the locomotive passing detection alarm device Mi comprises a locomotive passing induction signal generating circuit (IC1) connected to the signal output terminal of the whole range sensor component, and a setting "1" priority bistable circuit (IC2);

wherein a setting "1" terminal of the setting "1" priority bistable circuit IC2 is connected to the output terminal of the locomotive passing sensor signal generating circuit IC1, wherein a setting "0" terminal of the setting "1" priority bistable circuit IC2 is connected with a first OR gate, wherein the output terminal of the setting "1" priority bistable circuit IC2 is connected to an input terminal of an AND gate, wherein the other input terminal of said AND gate is connected with a second OR gate, wherein the output terminal of said AND gate is connected to a trigger terminal of an alarm signal transmitting circuit (IC3), and wherein the two input terminals of said first OR gate and second OR gate are respectively connected to the output terminals of the setting "1" priority bistable circuit IC2 in the onward adjacent locomotive passing detection alarm device Mi+1 and a backward adjacent locomotive passing detection alarm device (Mi−1).

* * * * *

UNITED STATES PATENT AND TRADEMARK OFFICE

CERTIFICATE OF CORRECTION

PATENT NO. : 8,985,522 B2
APPLICATION NO. : 13/825262
DATED : March 24, 2015
INVENTOR(S) : Wei Bai et al.

It is certified that error appears in the above-identified patent and that said Letters Patent is hereby corrected as shown below:

On the Title Page:

Item (75), Inventors: "Wei Bai (Shanghai, CN), Jing Bai (Shanghai, CN), Qing Bai (Shanghai, CN), Baolong Feng (Shanghai, CN)" should read -- Wei Bai (Shanxi, CN), Jing Bai (Shanxi, CN), Qing Bai (Shanxi, CN), Baolong Feng (Shanxi, CN) --.

Signed and Sealed this
Twenty-ninth Day of December, 2015

Michelle K. Lee

Michelle K. Lee
*Director of the United States Patent and Trademark Office*